US010315422B2

(12) United States Patent
Takagi

(10) Patent No.: US 10,315,422 B2
(45) Date of Patent: Jun. 11, 2019

(54) LIQUID DISCHARGING HEAD SUBSTRATE, LIQUID DISCHARGING HEAD, AND LIQUID DISCHARGING APPARATUS

(71) Applicant: CANON KABUSHIKI KAISHA, Tokyo (JP)

(72) Inventor: Makoto Takagi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/874,271

(22) Filed: Jan. 18, 2018

(65) Prior Publication Data

US 2018/0215149 A1 Aug. 2, 2018

(30) Foreign Application Priority Data

Feb. 1, 2017 (JP) ..... 2017-016975

(51) Int. Cl.
*B41J 2/14* (2006.01)
*B41J 2/045* (2006.01)

(52) U.S. Cl.
CPC ..... *B41J 2/1433* (2013.01); *B41J 2/14072* (2013.01); *B41J 2/0458* (2013.01); *B41J 2/04541* (2013.01); *B41J 2202/12* (2013.01)

(58) Field of Classification Search
CPC .. B41J 2/1433; B41J 2/14072; B41J 2202/12; B41J 2/04541; B41J 2/0458
See application file for complete search history.

(56) References Cited

U.S. PATENT DOCUMENTS 6,328,427 B1 * 12/2001 Watanabe ..... H01R 12/62 347/58
7,905,577 B2 * 3/2011 Takeuchi ..... B41J 2/04541 347/56
9,340,022 B1 5/2016 Fujii et al.
2008/0180487 A1 * 7/2008 Abe ..... B41J 2/14072 347/50
2011/0134192 A1 * 6/2011 Furukawa ..... B41J 2/04541 347/58
2016/0121608 A1 5/2016 Fujii et al.

FOREIGN PATENT DOCUMENTS

JP 2016-87941 A 5/2016

* cited by examiner

*Primary Examiner* — Henok D Legesse
(74) *Attorney, Agent, or Firm* — Venable LLP

(57) ABSTRACT

A liquid discharging head substrate, in which driving elements for driving discharging elements are arranged, the substrate comprising a conductive film, for supplying a power-supply voltage to the driving elements, provided to cover the driving elements in a plan view, and a power-supply pad, for receiving the power-supply voltage, provided at an end of the substrate in the plan view, wherein the conductive film has an outer shape that is not linearly symmetrical in the plan view, openings are formed in the conductive film, the conductive film has a first portion and a second portion whose impedance from the pad in the conductive film is smaller than that of the first portion, and the substrate further comprises a conductive pattern connecting the first portion and the second portion.

17 Claims, 10 Drawing Sheets

FIG. 1A
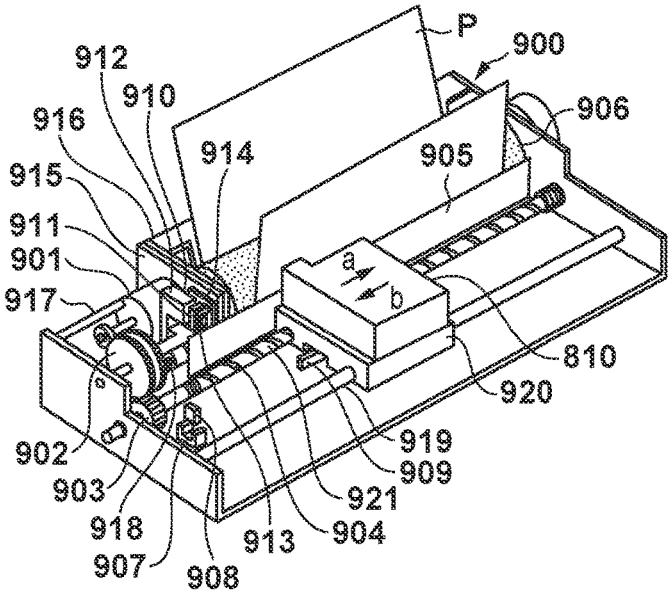
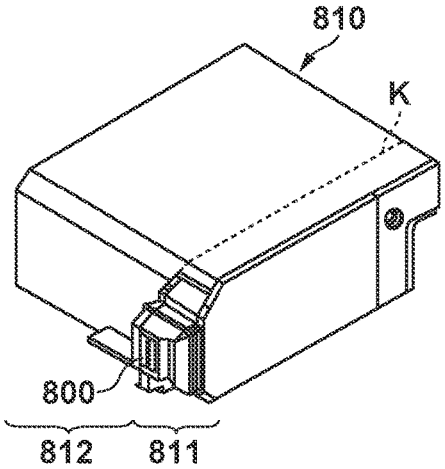
FIG. 1B
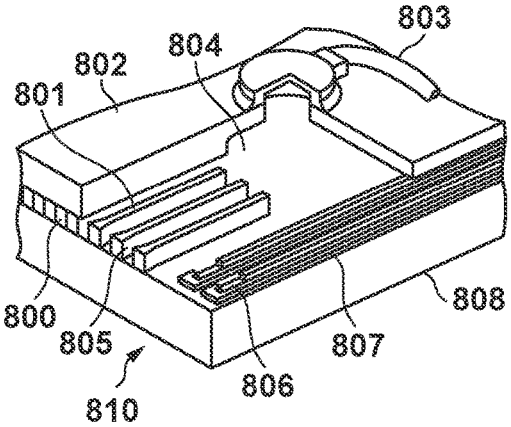
FIG. 1C

LIQUID DISCHARGING HEAD SUBSTRATE, LIQUID DISCHARGING HEAD, AND LIQUID DISCHARGING APPARATUS

BACKGROUND OF THE INVENTION

Field of the Invention

The present invention relates to a liquid discharging head substrate, a liquid discharging head, and a liquid discharging apparatus.

Description of the Related Art

A liquid discharging apparatus as typified by an ink-jet printer is equipped with a liquid discharging head, and in the liquid discharging head is provided a substrate (liquid discharging head substrate) in which a plurality of discharging elements for performing a liquid discharge are arranged (refer to Japanese Patent Laid-Open No. 2016-087941). In each discharging element, an electrothermal transducer element (heater element), for example, is used. Thermal energy is generated when a driving current is supplied to the respective discharging elements, and liquid is discharged from a nozzle (discharge port) disposed in the liquid discharging head when the liquid to which the thermal energy is applied bubbles.

Note that since a relatively large current is supplied to each of the discharging elements in order to perform liquid discharge appropriately, there is the possibility that a voltage drop will occur in a power-supply line that transmits a power-supply voltage that is supplied to each of the discharging elements. For this reason, it is advantageous to reduce an impedance component (parasitic resistance component) of the power-supply line.

However, the power-supply voltage is typically supplied to the power-supply line from outside via an electrode pad (power-supply pad) arranged at an end portion of the liquid discharging head substrate. For this reason, a difference in impedance due to the distance from this electrode pad may arise between different portions on the power-supply line. As a result, it is possible that a difference in the values of the power-supply voltage that is supplied (supply voltage) will arise between discharging elements that are provided at different positions.

SUMMARY OF THE INVENTION

The present invention provides a technique that is advantageous at reducing a difference in values of supply voltage that can occur between discharging elements.

One of the aspects of the present invention provides a liquid discharging head substrate in which a plurality of driving elements for respectively driving a plurality of discharging elements for discharging liquid are arranged on a semiconductor substrate, the liquid discharging head substrate comprising a conductive film provided to cover a region in which the plurality of driving elements are arranged in a plan view corresponding to the top surface of the semiconductor substrate, so as to supply a power-supply voltage to the plurality of driving elements, and a power-supply pad provided at an end of the semiconductor substrate in the plan view, and into which the power-supply voltage is inputted from outside, wherein the conductive film has an outer shape that is not linearly symmetrical in relation to a line orthogonal to an edge at which the power-supply pad of the semiconductor substrate is provided in the plan view, and a plurality of openings are disposed in the conductive film, the conductive film has a first portion and a second portion wherein an impedance of the conductive film from the power-supply pad to the second portion is smaller than an impedance of the conductive film from the power-supply pad to the first portion, and the liquid discharging head substrate further comprises a conductive pattern that electrically connects the first portion and the second portion in a layer different to the conductive film.

Further features of the present invention will become apparent from the following description of exemplary embodiments with reference to the attached drawings.

BRIEF DESCRIPTION OF THE DRAWINGS

FIG. 1A, FIG. 1B, FIG. 1C, and FIG. 1D are views for describing an example of a configuration of a liquid discharging apparatus.

DESCRIPTION OF THE EMBODIMENTS

Figure 1D:
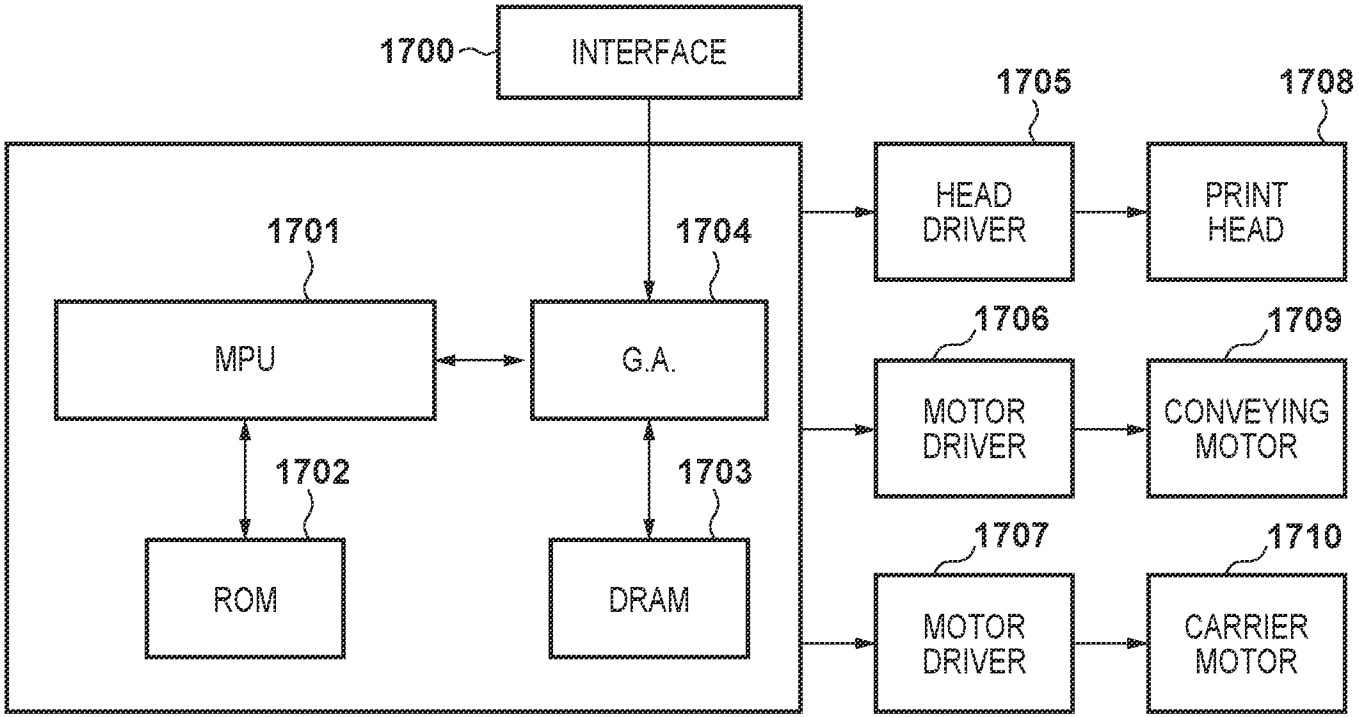

Hereinafter, explanation will be given regarding a preferred embodiment of the present invention with reference to the attached drawings. Note that each drawing is given merely with the objective of describing the structure or configuration, and the dimensions of each member shown graphically do not necessarily reflect the actual dimensions. Also, in the drawings, the same reference numerals are given to members that are the same and elements that are the same, and duplicate descriptions of content are omitted below.

(Example of Configuration of Liquid Discharging Apparatus)

FIG. 1A exemplifies an internal configuration of a liquid discharging apparatus 900 as typified by an ink-jet printer, a facsimile, a copy machine, or the like. In the present example, the liquid discharging apparatus may also be referred to as a printing apparatus. The liquid discharging apparatus 900 comprises a liquid discharging head 810 that discharges liquid (ink, a print agent in the present example) onto a predetermined medium P (a print medium such as a sheet in the present example). In the present example, the liquid discharging head may be referred to as a printhead. The liquid discharging head 810 is mounted on a carriage 820, and the carriage 820 may be attached to a lead screw 921 that has a spiral groove 904. The lead screw 921, via driving force conveying gears 902 and 903, can rotate by linking with the rotation of a driving motor 901. By this, the liquid discharging head 810 can move in the directions of arrow symbols a and b following a guide 919 together with the carriage 820.

The medium P is pressed in a direction of movement of the carriage by a paper pressing plate 905, and fixed in relation to a platen 906. The liquid discharging apparatus 900 causes the liquid discharging head 810 to move reciprocally, and performs a liquid discharge (printing in the present example) onto the medium P which has been conveyed onto the platen 906 by a conveying unit (not shown).

Also, the liquid discharging apparatus 900, via photocouplers 907 and 908, confirms the position of a lever 909 disposed on the carriage 820, and switches the rotation direction of the driving motor 901. A support member 910 supports a cap member 911 for covering a nozzle (a liquid discharging port/orifice, or simply a discharge port) of the liquid discharging head 810. A suction unit 912 performs a recovery process for the liquid discharging head 810 by sucking inside of the cap member 911 via an in-cap opening 913. A lever 917 is disposed in order to start the recovery process by suction, and moves along with movement of a cam 918 that engages with the carriage 820, and a driving force from the driving motor 901 is controlled by a known transmitting unit such as a clutch switch or the like.

Also, a main body support plate 916 supports a moving member 915 and a cleaning blade 914, and the moving member 915 causes the cleaning blade 914 to move, and performs a recovery process of the liquid discharging head 810 by wiping. Also, a control unit (not shown) is disposed on the liquid discharging apparatus 900, and the control unit controls driving of each mechanism described above.

FIG. 1B exemplifies an outer appearance of the liquid discharging head 810. The liquid discharging head 810 may comprise a head unit 811 that has a plurality of nozzles 800 and a tank (liquid reservoir) 812 that holds liquid to be supplied to the head unit 811. The tank 812 and the head unit 811 can be separated at the dashed line K, for example, and the tank 812 can be replaced. The liquid discharging head 810 comprises an electrical contact (not shown) for receiving an electrical signal from the carriage 820, and discharges liquid in accordance with the electrical signal. The tank 812 has a liquid holding member (not shown) of a fibrous form or a porous form, for example, and liquid can be held by the liquid holding member.

FIG. 1C exemplifies an internal configuration of the liquid discharging head 810. The liquid discharging head 810 comprises a substrate 808, channel wall members 801 provided on the substrate 808 that form channels 805, and a top plate 802 which has a liquid supply channel 803. Also, as a discharging element or a liquid discharging element, heaters 806 (electrothermal transducer element) are arranged to correspond to each of the nozzles 800 on the substrate (liquid discharging head substrate) that the liquid discharging head 810 comprises. Each of the heater 806 generates heat when driven by a driving element disposed to correspond with the heater 806 (a switching element such as a transistor) entering a conductive state.

The liquid from the liquid supply channel 803 is stored in a common liquid chamber 804, and supplied to each of the nozzles 800 via the channels 805. The liquid supplied to a respective nozzle 800 is discharged from the nozzle 800 in response to the heater 806 corresponding to the nozzle 800 being driven.

FIG. 1D exemplifies a system configuration of the liquid discharging apparatus 900. The liquid discharging apparatus 900 has an interface 1700, an MPU 1701, a ROM 1702, a RAM 1703, and a gate array 1704. An external signal for executing a liquid discharge is inputted from outside to the interface 1700. The ROM 1702 stores a control program that the MPU 1701 executes. The RAM 1703 saves various signals or data such as the previously described external signal for liquid discharge or data supplied to a liquid discharging head 1708. The gate array 1704 performs data supply control corresponding to the liquid discharging head 1708, and performs control of data transfer between the interface 1700, the MPU 1701, and the RAM 1703.

The liquid discharging apparatus 900 also has a head driver 1705, as well as motor drivers 1706 and 1707, a conveying motor 1709, and a carrier motor 1710. The carrier motor 1710 conveys the liquid discharging head 1708. The conveying motor 1709 conveys the medium P. The head driver 1705 drives the liquid discharging head 1708. The motor drivers 1706 and 1707 drive the conveying motor 1709 and the carrier motor 1710 respectively.

When a driving signal is inputted into the interface 1700, this driving signal can be converted into data for liquid discharge between the gate array 1704 and the MPU 1701. In accordance with this data, each mechanism performs a desired operation, and in this way, the liquid discharging head 1708 is driven.

First Embodiment

Figure 2A:
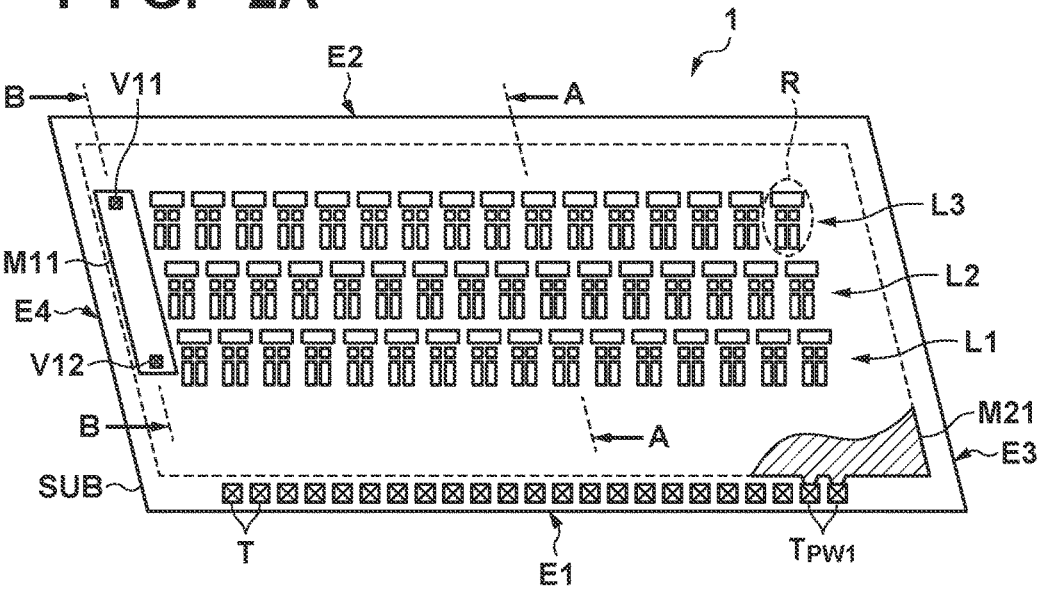
FIG. 2A, FIG. 2B, and FIG. 2C are views for describing an example of a structure of a liquid discharging head substrate.

FIG. 2A illustrates a top surface layout of a liquid discharging head substrate 1 according to the first embodiment. The liquid discharging head substrate 1 comprises a semiconductor substrate SUB and a plurality of electrode pads T. The semiconductor substrate SUB, in a plan view corresponding to the top surface (an orthogonal projection in a direction orthogonal to the top surface or a surface parallel thereto may be represented; hereinafter, referred to simply as "plan view"), has edges E1 and E2 which oppose each other, and edges E3 and E4 which intersect these and oppose each other.

In the present embodiment, the semiconductor substrate SUB has a parallelogram shape in the plan view, but the outer shape of the semiconductor substrate SUB may be a quadrangle such as a rectangular shape or a polygon, and limitation is not made to this example. In the present embodiment, an acute angle is formed between the edge E1 and the edge E3, an obtuse angle is formed between the edge E1 and the edge E4, an obtuse angle is formed between the edge E2 and the edge E3, and an acute angle is formed between the edge E2 and the edge E4.

In the present embodiment, the plurality of electrode pads T are arranged along the edge E1 at an end of the semiconductor substrate SUB. The plurality of electrode pads T include power-supply pads $T_{PW1}$ for receiving a power-supply voltage (voltage V1) from outside. In the present embodiment, two power-supply pads $T_{PW1}$ are provided at positions closer to the edge E3 than the edge E4. Note that though not illustrated here, the plurality of electrode pads T further include a power-supply pad (power-supply pad $T_{PW2}$) for receiving another power-supply voltage (voltage V2) from outside.

Figure 2B:
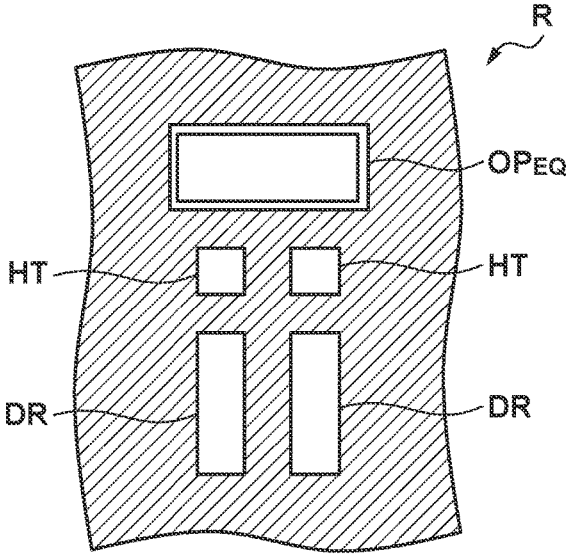

FIG. 2B illustrates a magnification view for a region R illustrated in FIG. 2A. On the semiconductor substrate SUB, heaters HT corresponding to discharging elements and driving elements DR for driving the heaters HT are respectively provided, and, on the semiconductor substrate SUB, one or more liquid supply ports (openings) $OP_{EQ}$ for supplying liquid to the heaters HT are disposed. In the present embodiment, two heaters HT and two driving elements DR are provided for one supply port $OP_{EQ}$, but there is no limitation to this 2:2:1 ratio example.

With reference to FIG. 2A once again, in the present embodiment, a plurality (16 rows×3 lines) of supply ports $OP_{EQ}$ are disposed on the semiconductor substrate SUB, and on the substrate SUB, 32 rows×3 lines of heaters HT and driving elements DR are arranged. In the drawing, a line closest to the edge E1 is referred to as a first line L1, the next closest line to the edge E1 is referred to as a second line L2, and the line that is the most separated from the edge E1 is referred to as a third line L3.

Figure 2C:
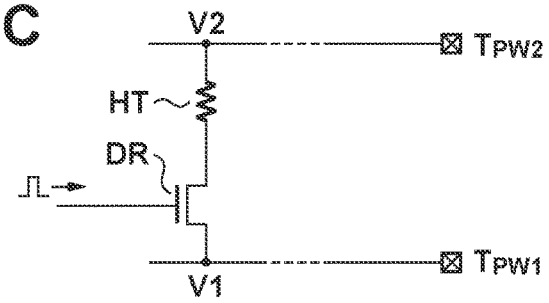

As illustrated in FIG. 2C, each heater HT is connected in series to one corresponding driving element DR in the electrical path between the voltages V1 and V2. In the present embodiment, the driving element DR is provided at the voltage V1 side, and the heater HT is provided at the voltage V2 side, but these positions may be inverted. Note that the voltage V1 corresponds to a ground voltage (for example, 0[V]), and the voltage V2 corresponds to a constant voltage of a positive value (for example, 24[V]). Typically, a high-voltage tolerant transistor such as a DMOS transistor is used for the driving element DR, and the heater HT is driven to cause it to generate heat in accordance with a control signal or a driving signal supplied to its gate.

With reference to FIG. 2A once again, the liquid discharging head substrate 1 comprises a conductive film M21 and a conductive pattern M11. This is described below with reference to FIG. 3.

Figure 3:
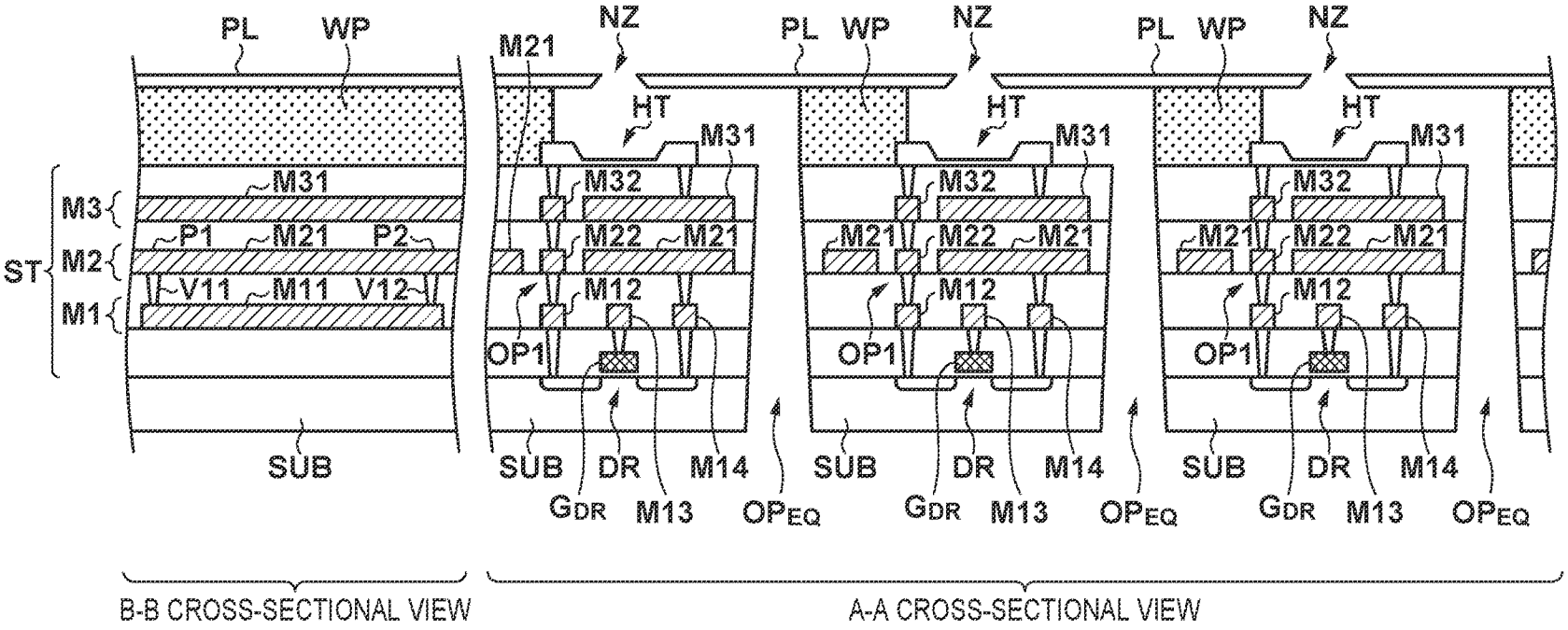
FIG. 3 is a view for describing a cross-sectional structure of the liquid discharging head substrate.

FIG. 3 illustrates a cross-sectional view for the line A-A and a cross-sectional view for the line B-B in relation to FIG. 2A. The liquid discharging head substrate 1 further comprises a wiring structure ST on the semiconductor substrate SUB on which the driving elements DR are formed. The heater HT is provided on the wiring structure ST. The liquid discharging head substrate 1 comprises a channel wall WP that is provided on the wiring structure ST and forms liquid channels, and a nozzle plate PL provided on the channel wall WP. On the nozzle plate PL, the nozzles NZ are disposed immediately above the heaters HT.

In the present embodiment, the wiring structure ST is a multilayer wiring structure formed by alternatingly stacking an interlayer insulation film and a wiring layer. In the present embodiment, there are three wiring layers, and the wiring structure ST includes a wiring layer M1 which is the closest layer to the semiconductor substrate SUB, a wiring layer M2 which is the layer above the wiring layer M1, and a wiring layer M3 which is the layer above the wiring layer M2.

The wiring layer M3 includes a conductive film M31 and a connecting portion M32. The wiring layer M2 includes the conductive film M21 and a connecting portion M22. The wiring layer M1 includes the conductive pattern M11, a connecting portion M12, a line pattern M13 for a control signal, and a connecting portion M14.

The conductive film M31 is electrically connected to the previously described power-supply pad $T_{PW2}$ and corresponds to a power-supply voltage node that transmits the voltage V2, and is electrically connected to a terminal of a heater HT. This connection between the conductive film M31 and the heater HT is realized via a plug. The plug is a conductive member that extends vertically with respect to the top surface of the semiconductor substrate SUB, and may be referred to as a contact plug, a via, or the like (same below). Note that this is similar even in a case where this plug and the heater HT are formed to be integrated such as in a case where the plug is formed by a damascene method.

The conductive film M21 corresponds to a power-supply voltage node that is electrically connected to the previously described power-supply pads $T_{PW1}$ and transmits the voltage V1, and the conductive film M21 is electrically connected to a source terminal of a driving element DR. This connection between the conductive film M21 and the driving element DR is realized via the connecting portion M14, a plug connecting the connecting portion M14 and the conductive film M21, and a plug connecting a source terminal of the driving element DR and the connecting portion M14.

The line pattern M13 is electrically connected to the drain electrode $G_{DR}$ of the driving element DR. This connection is realized via a plug.

The other terminal of the heater HT (the terminal on the side opposite to the side that the conductive film M31 is connected to) and the source terminal of the driving element DR are electrically connected by the connecting portions M12, M22, and M32, and a plurality of plugs (these may be represented collectively as a connecting portion) that connect these. An opening OP1 for realizing this connection (specifically for passing through the connecting portion M22) is disposed in the conductive film M21. In other words, a plurality of openings OP1 are disposed in the conductive film M21 at the same pitch as the arrangement pitch of the driving elements DR and the heaters HT.

In the present embodiment, in addition to the opening OP1, an opening for forming a supply port $OP_{EQ}$ described previously is also arranged in the conductive film M21. Note that, an opening for realizing another connection between the wiring layers M1 to M3 may be further arranged as necessary.

The previously described supply ports $OP_{EQ}$, which are for supplying liquid to the heaters, are disposed between the driving elements DR. The supply ports $OP_{EQ}$ are disposed so as to extend through the semiconductor substrate SUB from its bottom surface side to its top surface side, and communicate with the nozzles NZ disposed in the nozzle plate PL. In a case where the driving element DR enters a conductive state and the heater HT is driven, it causes the liquid above the heater HT to bubble, and the liquid is thereby discharged from the nozzle NZ.

Note that on the side surface of the supply port $OP_{EQ}$, a protective film (not shown) is formed for protecting the wiring structure ST from the liquid. Also, on the top surface of the wiring structure ST and the heater HT, a protective film (not shown) is formed for protecting these from the liquid.

As illustrated in the cross-sectional structure for the line B-B, the driving element DR is not arranged in this region, and the connecting portions M12 and M14 and the line pattern M13 for the control signal are not arranged in the wiring layer M1. Therefore, in this region, the conductive films M21 and M31 are respectively arranged in the wiring layer M2 and the wiring layer M3, and the conductive pattern M11 which is connected in parallel with the conductive film M21 is arranged. Though details are described later, the conductive film M21 includes a portion P1 which is a part thereof and a portion P2 which is another part thereof. Also, the conductive pattern M11 is connected to the portion P1 of the conductive film M21 by a plug V11 at one terminal, and is connected to the portion P2 of the conductive film M21 by a plug V12 at the other terminal.

The conductive pattern M11 has a function for assisting a supply of the voltage V1 by the conductive film M21, and may be referred to as an assisting wiring pattern, an assisting line pattern, or the like. In the present specification, "assisting" indicates an action of ancillarily compensating a predetermined function. Accordingly, in this regard, even if the conductive pattern M11 hypothetically is not arranged, a voltage supply function of the conductive film M21 is not lost in the liquid discharging head substrate 1. In the present embodiment, a connecting portion such as the plug for connecting to the semiconductor substrate SUB (or a circuit or element formed on the semiconductor substrate SUB) is not disposed immediately below the conductive pattern M11. In other words, the bottom surface of the conductive pattern M11 is covered in an interlayer insulation film across the entire region.

Figure 4A:
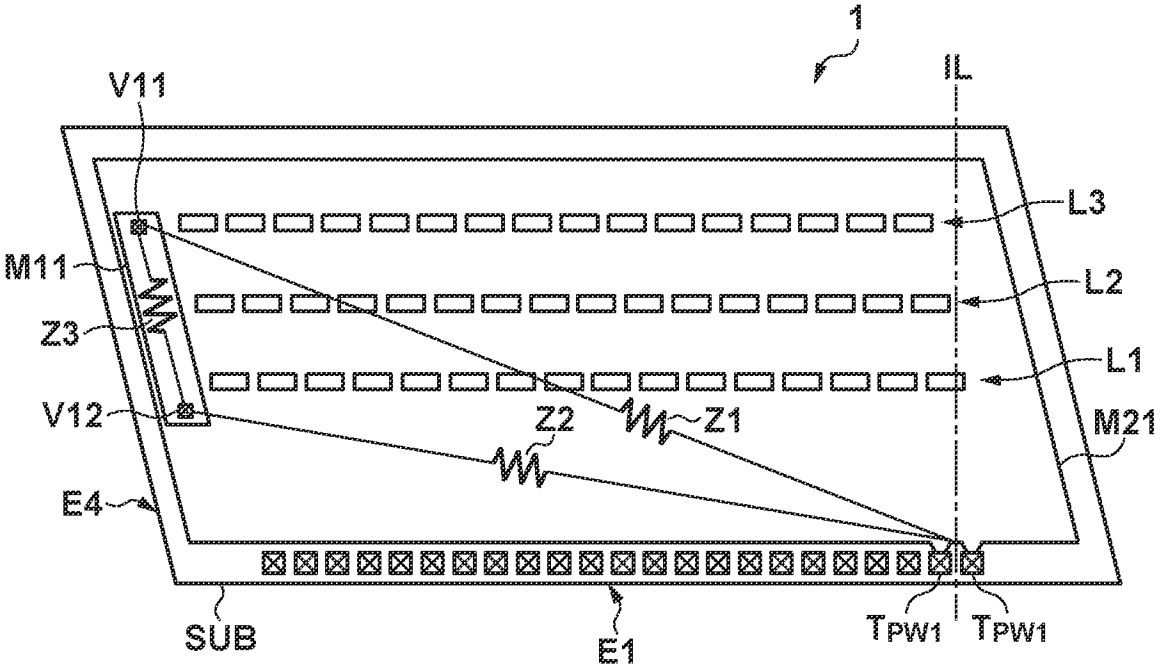
FIG. 4A and FIG. 4B are views for describing an example of a structure of the liquid discharging head substrate and an example of electrical characteristics thereof.

FIG. 4A is a simplified depiction of the top surface layout illustrated in FIG. 2A. The conductive film M21, in the plan view, is connected to the two power-supply pads $T_{PW1}$ provided in the vicinity of the edge E1, and extends so as to cover a region in which the plurality of driving elements DR of the lines L1 to L3 are provided (so as to cover the entire plurality of driving elements. In this regard, the conductive film M21 only has the previously described opening OP1, and lacks a site of substantial branching (for example, a pattern in a line form or an oblong rectangle shape or a sub-channel). Also, the conductive film M21 is of a shape in which it overlaps with some but not all of the heaters HT due to the opening OP1, and in which it overlaps a part of, but not all of, the driving elements DR.

Even with such a structure, a difference in the impedance component according to the distance from the power-supply pads $T_{PW1}$ may arise between two different portions in the conductive film M21. In the present embodiment, since the two power-supply pads $T_{PW1}$ are close to the edge E3 side, there is the possibility that a difference in the impedance component will arise on the side of the edge E4 with respect to a virtual line IL that passes between the two power-supply pads $T_{PW1}$and is orthogonal to the edge E1. Note that there is a possibility that in the line L3, the driving elements DR will all be positioned on the side of the edge E4 with respect to the virtual line IL, and that the closer they are to the edge E4 side, the smaller the supplied voltage will be.

In the present embodiment, in the conductive film M21, the portions in the vicinity of the end on the edge E4 side of line L1 and the portions in the vicinity of the end on the side of edge E4 in the line L3 are focused on, and these respectively correspond to previously described portions P1 and P2. Here, Z1 is the impedance from the power-supply pad $T_{PW1}$ in the conductive film M21 of the portion P1, and Z2 is the impedance from the power-supply pad $T_{PW1}$ in the conductive film M21 of the portion P2. The above described impedances are combined impedances in a planar direction of the conductive film M21. Also, "in the conductive film M21" means that the conductive pattern M11 is not considered (in other words, it is assumed that the conductive pattern M11 is not connected to the conductive film M21, or that the state is prior to the conductive pattern M11 being added). Note that in the present embodiment, since the portion P1 is further from power-supply pads $T_{PW1}$ than the portion P2, Z1>Z2.

As previously described, the portion P1 and the portion P2 are electrically connected by the conductive pattern M11.

Here, Z3 is the impedance from one end to the other end of the conductive pattern M11. Since the conductive pattern M11 does not have a width that is as a wide as the conductive film M21, typically, Z3<Z1 and Z3<Z2.

In such a case, assuming Z1' is the actual impedance from the power-supply pads $T_{PW1}$ of the portion P1, and Z2' is the actual impedance from the power-supply pads $T_{PW1}$ of the portion P2, Z1' and Z2' can be expressed as follows. Z1'=(Z1×Z2+Z1×Z3)/(Z1+Z2+Z3) and Z2'=(Z2×Z1+Z2×Z3 )/(Z1+Z2+Z3). Here, "actual" means that the conductive pattern M11 is considered (in other words, it is the impedance in the structure in which the conductive film M21 and the conductive pattern M11 are connected in parallel).

Here, assuming ΔZ1 is the difference in impedance of the portion P1 before/after adding the conductive pattern M11, and ΔZ2 is the difference in impedance of the portion P2 before/after adding the conductive pattern M11, ΔZ1 and ΔZ2 are expressed as follows.

$$\Delta Z1 = Z1 - Z1' = Z1^2/(Z1 + Z2 + Z3)$$

$$\Delta Z2 = Z2 - Z2' = Z2^2/(Z1 + Z2 + Z3)$$

Here, since Z1 to Z3>0, ΔZ1>0, and ΔZ2>0. This indicates that by addition of the conductive pattern M11, the impedance of both the portions P1 and P2 is reduced.

Also, because Z1>Z2, ΔZ1>ΔZ2 holds. This indicates that the change (decrease value) of impedance in relation to the portion P1 due to addition of the conductive pattern M11 is larger than the change of impedance in relation to the portion P2. Alternatively, it can be said that the conductance applied with respect to the portion P1 by the conductive pattern M11 is larger than the conductance applied with respect to the portion P2.

Figure 4B:
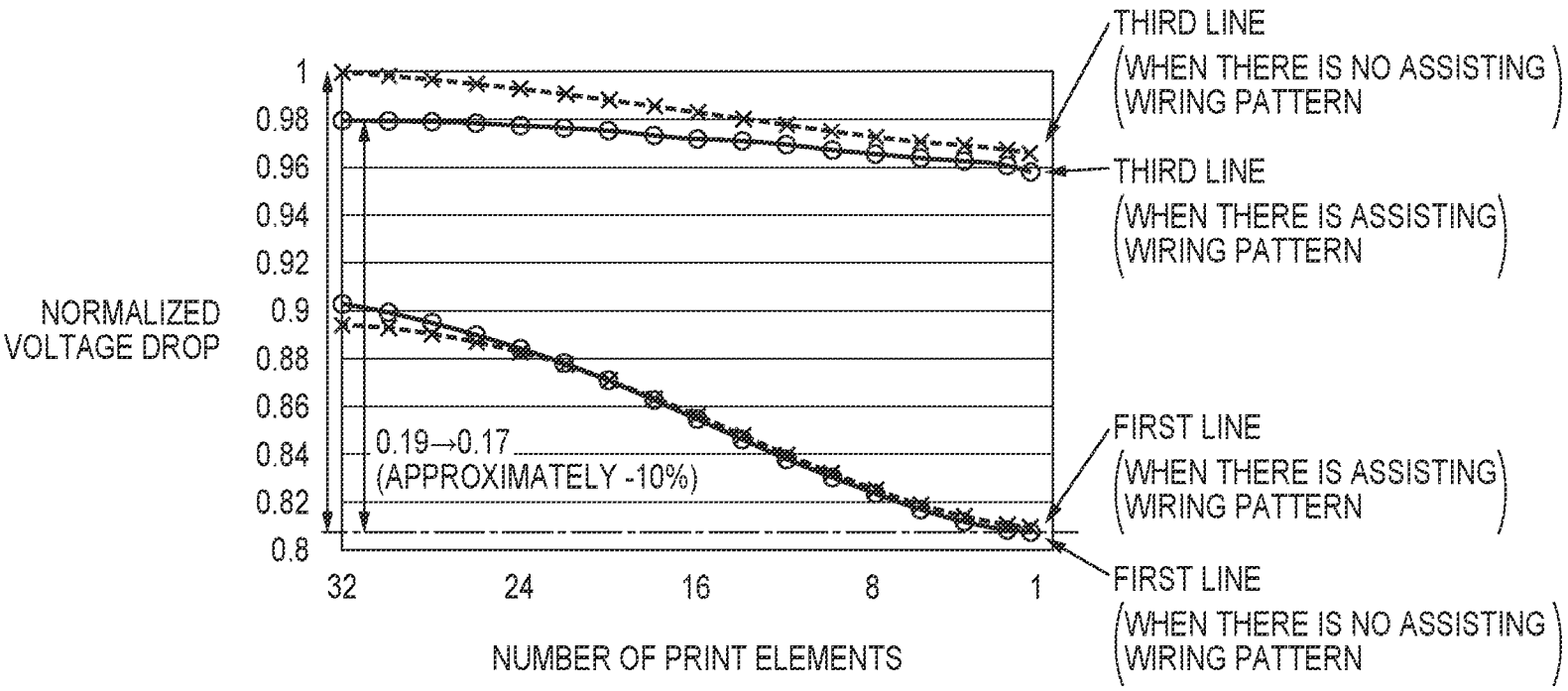

FIG. 4B is a plot indicating the influence of a voltage drop before/after adding the conductive pattern M11. The abscissa indicates the element number (numbers identifying the 32 individual heaters HT in each row), and these numbers range from 1 to 32 in order from the edge E3 side to the edge E4 side (from the right side to the left side in the drawing). The ordinate indicates an amount of voltage drop in the portions corresponding to each element number in the conductive film M21 normalized by the amount of voltage drop of the number 32 of the line L3 whose amount of voltage drop is the largest prior to adding the conductive pattern M11. In the drawing, plot values for the amount of voltage drop of the portions corresponding to the respective element numbers of the first line L1 and the third line L3 in the case where all heaters HT are driven are indicated (values for prior to adding the conductive pattern M11 are shown graphically as a "×" symbol and values for after adding the conductive pattern M11 are shown graphically as a "○" symbol).

As can be seen in FIG. 4B, in the line L3, a voltage drop after adding the conductive pattern M11 is suppressed as compared to prior to adding the conductive pattern M11, and in the present embodiment, an effect of suppressing a voltage drop of about 10% for element number 32 occurs. Note that in the line L1, as described with reference to ΔZ1 and ΔZ2, the effect on the voltage drop due to the addition of the conductive pattern M11 is small, and it is particularly small in regions whose element number is particularly small (the regions element numbers 1 to 24).

By virtue of the present embodiment, it is possible to make the difference in impedance between two different portions of the conductive film M21 smaller. Specifically, the conductive film M21 for supplying the voltage V1 to the plurality of driving elements DR extends so as to cover the region in which the plurality of driving elements DR is provided (so as to cover all of the plurality of driving elements DR). Furthermore, the conductive pattern M11 is connected between the aforementioned two portions between which an impedance difference may arise in the conductive film M21. Thereby, the voltage drop in the conductive film M21 is suppressed, and as a result, the difference in the values of supplied voltage (voltage actually supplied which may be smaller than the voltage V1) that may arise between these two portions is reduced, and it is possible to uniformize the distribution of voltage. This is particularly advantageous in increasing the number of heaters HT (increasing the number of driving elements DR). The conductive pattern M11 extends in a direction parallel to the edge E1 so as to overlap with all of the driving elements DR of the lines L1 to L3.

The conductive film M21 and the conductive pattern M11 are respectively provided for the wiring layers M2 and M1 of the wiring structure ST. As illustrated in the A-A cross-sectional structure of FIG. 3, in the region in which the driving element DR is arranged, the opening OP1 for realizing a connection between the heater HT and the driving element DR is arranged in the conductive film M21. Meanwhile, as illustrated in the B-B cross-sectional structure of FIG. 3, in a region in which the driving element DR is not arranged, the opening OP1 is not disposed in the conductive film M21, and accordingly, the rigidity of the substrate 1 is ensured. Also, in the conductive film M21, the conductive pattern M11 is connected in parallel in the wiring layer M1 of the lower layer, and thereby it is possible to reduce the aforementioned impedance difference and further improve the rigidity of the substrate 1.

Also, with regards to suppressing the voltage drop due to the aforementioned impedance difference and reducing the difference in supplied voltage, the present embodiment is particularly advantageous in not only in a case of increasing the number of driving elements DR but also in a case of increasing the number of these that are simultaneously driven. Accordingly, in a case where the liquid discharging apparatus is a printing apparatus such as a printer (in a case where the liquid discharging head is a printhead), it becomes possible to increase the number of regions that can be printed simultaneously, and it is advantageous in increasing the number of dots formed per unit time (specifically, improve to printing speed). Furthermore, by virtue of the present embodiment, it becomes possible to reduce unnecessary power consumption in conjunction with reducing the impedance in a power-supply voltage node, and this is advantageous with regards to improving the product lifespan.

In the present embodiment, the conductive film M21 through which the voltage V1 is transmitted is focused on, but the content of the present embodiment can be applied to the conductive film M31 through which the voltage V2 is transmitted. That is, the conductive film M21 and/or M31 can extend so as to cover a region in which a plurality of driving elements DR are provided in the plan view. Also, in the conductive film M21 and/or M31, an opening (OP1) for realizing an electrical connection between the heater HT and the driving element DR and an opening corresponding to a supply port ($OP_{EQ}$) for supplying liquid to the heater HT are formed. In this regard, the conductive film M21 and/or M31 can be said to have a lattice shape in the plan view. Also, the outer shape of the conductive film M21 in the plan view is a parallelogram in the present embodiment, but it may be a quadrangle or a polygonal shape (this is similar for the conductive film M31).

Also, in the present embodiment, the conductive film M31 transmits the voltage V2, and the conductive films M21 and M11 transmit the voltage V1 (refer to FIG. 3), but it is possible to make a change as appropriate to arrange these in any wiring layer. For example, configuration may be taken to arrange a conductive film that transmits the voltage V1 in the wiring layer M3, and to arrange a conductive film that transmits the voltage V2 in the wiring layers M1 to M2. Also, for example, in a case where the wiring structure ST comprises another wiring layer (referred to as wiring layer M4), configuration may be taken to arrange a conductive film that transmits the voltage V1 (V2) in the wiring layers M1 to M3, and to arrange a conductive film that transmits the voltage V2 (V1) in the wiring layer M4.

Also, in the present embodiment, the conductive film M21 has an outer shape that is not linearly symmetrical with respect to the line L1 which is orthogonal to the edge E1. In the present embodiment, the outer shape of the conductive film M21 is a parallelogram. For this reason, a difference in impedance between the two portions described above tends to appear. Also, since the outer shape of the conductive film M21 is not linearly symmetrical, reducing the aforementioned impedance difference by changing the arrangement of the power-supply pads $T_{PW1}$, for example, is more difficult than in the case of a linearly symmetrical outer shape. In particular, if the outer shape of the conductive film M21 is a parallelogram as in the present embodiment, the aforementioned impedance difference may become a significant problem at a corner that is relatively far from the power-supply pads $T_{PW1}$, namely the acute angle portion between the edge E2 and the edge E4 in the present embodiment.

In the present embodiment, two portions whose impedances from the power-supply pad $T_{PW1}$ in the conductive film M21 differ are connected by the conductive pattern M11. In the present embodiment, a portion P1 having relatively high impedance (the acute angle portion between the edge E2 and the edge E4 in the present embodiment) and a portion P2 with comparatively lower impedance are connected by the conductive pattern M11. Thus, it is possible to concentratedly suppress a reduction of the supplied voltage in the portion P1 whose impedance is relatively higher. Thus, in the liquid discharging head substrate 1, it is possible to reduce the difference in supplied voltage that can arise due to the difference in distance from the power-supply pads $T_{PW1}$. In the present embodiment, the conductive film M21 has an outer shape that is not linearly symmetrical, and the aforementioned impedance difference and a difference in supplied voltage associated therewith tends to occur, and therefore it is possible to effectively reduce these differences by virtue of the present embodiment.

To summarize, in a case where the outer shape in the plan view of the conductive film M21 is not linearly symmetrical with respect to the line L1 which is orthogonal to the edge E1 at which the power-supply pads $T_{PW1}$ are provided, and in particular in the case of a parallelogram, a difference in impedance between two portions arises due to distances from the power-supply pads $T_{PW1}$ differing. In a case in which the outer shape of the conductive film M21 is a parallelogram, the impedance of the acute angle portion between the edge E2 and the edge E4 which is far from the power-supply pads $T_{PW1}$ is higher than other portions, and this impedance difference becomes more significant than in the case where the shape of the conductive film M21 is a rectangular shape. Accordingly, by adding the conductive pattern M11 as an assisting wiring line, the aforementioned impedance difference and the difference in supplied voltage associated therewith are effectively reduced.

Note that the conductive pattern M11 is not in surface contact over the entirety of its top surface with the bottom surface of the conductive film M21; rather, it is connected via the plug V11 to the portion P1 of the conductive film M21 at one end and it is connected via the plug V12 to the portion P2 of the conductive film M21 at the other end. Thereby, it becomes possible to concentratedly impart the effect of lowering the impedance in relation to the portion P1 whose impedance from the power-supply pad $T_{PW1}$ is relatively high.

In the present embodiment, the above-mentioned conductive pattern M11, for assisting the supply of the voltage V1, is provided in the wiring layer M1. However, as another embodiment, the conductive pattern M11 may be provided in the wiring layer M3 which includes the conductive pattern M31 for supplying the voltage V2. That is, by providing the conductive pattern M11 in a layer (M1 or M3) different from the layer (M2) which mainly functions to supply the voltage V1, the above-mentioned assisting of the supply of the voltage V1 may be realized correctly, and thereby, it may become possible to avoid or suppress the lowering of the drivability of the driving elements DR.

Second Embodiment

Figure 5A:
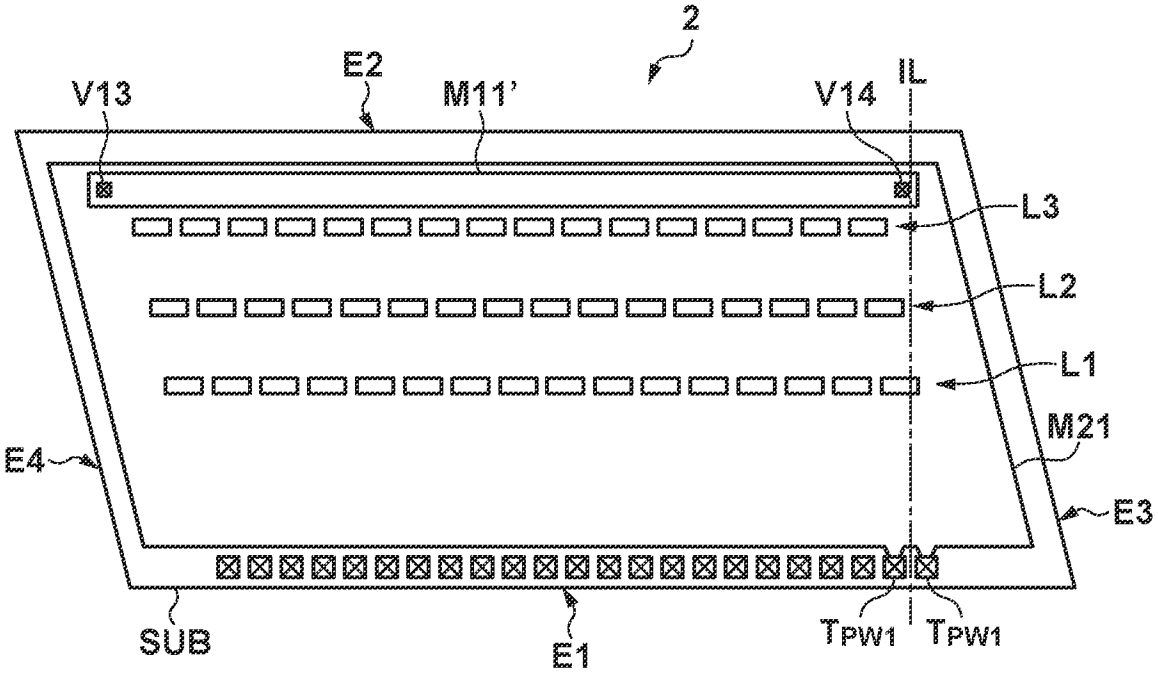
FIG. 5A and FIG. 5B are views for describing an example of a structure of the liquid discharging head substrate and an example of electrical characteristics thereof.

FIG. 5A illustrates a top surface layout of a liquid discharging head substrate 2 according to a second embodiment. The present embodiment mainly differs from the previously described first embodiment in that a conductive pattern M11' which is provided along the edge E2 is arranged in place of the conductive pattern M11 provided along the edge E4.

The conductive pattern M11' extends from one end of the line L3 to the other end on the side of the edge E2 with respect the line L3 in the conductive film M21. The conductive pattern M11' extends in a direction orthogonal to the edge E1 so as to overlap with all of the driving elements DR of at least the line L3. The conductive pattern M11', at one end, is connected by the plug V13 to a portion corresponding to the conductive film M21, and, at the other end, is connected by the plug V14 with a portion corresponding to the conductive film M21.

As described previously, there will be different portions between which there is a difference in the impedance component in the region on the side of the edge E4 in relation to the virtual line IL of the conductive film M21. For that reason, in the vicinity of the edge E2 (in particular, in the line L3), a difference in the impedance component may arise depending on which of the edge E3 and the edge E4 is closer, and in the present embodiment, the conductive pattern M11' will be used to make this difference smaller.

Figure 5B:
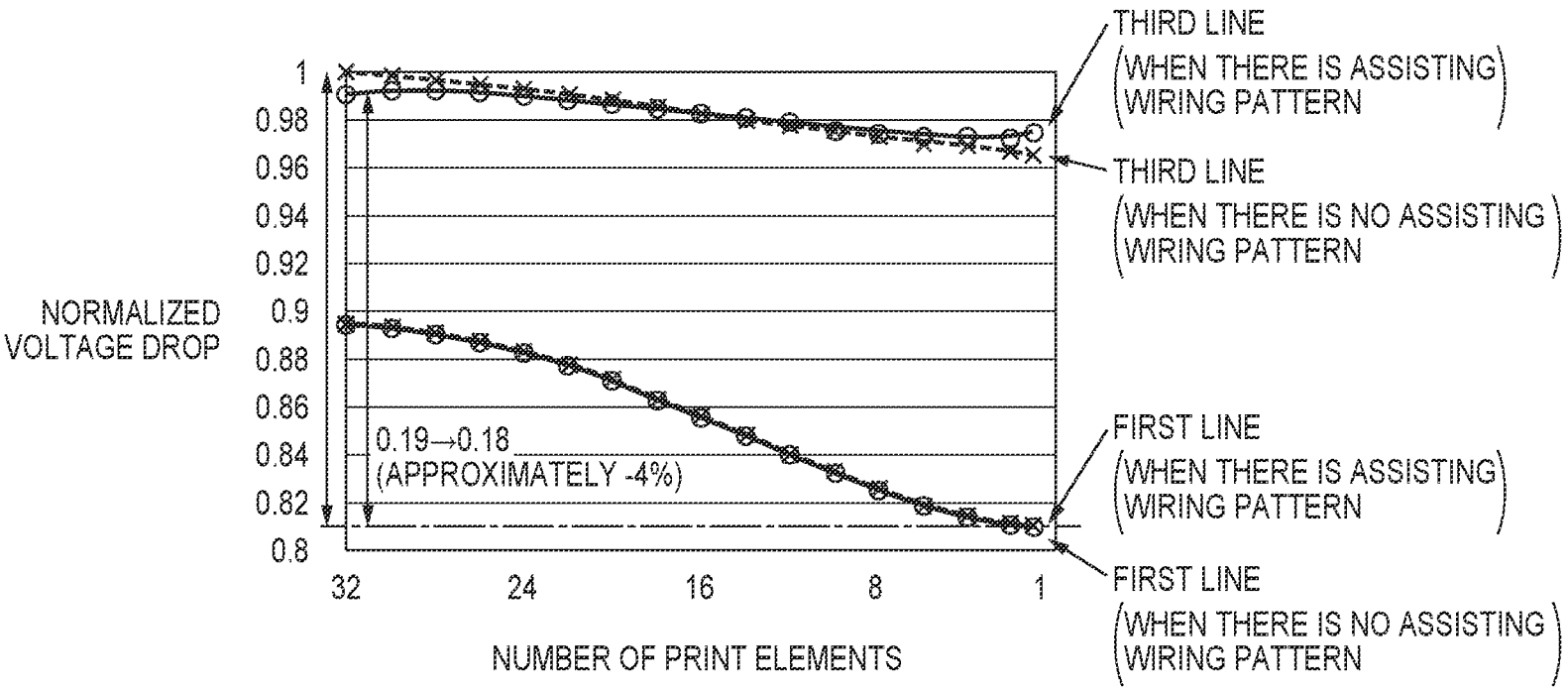

FIG. 5B is a plot indicating the influence of a voltage drop before/after adding the conductive pattern M11', and is similar to FIG. 4B. As can be seen in FIG. 5B, in the line L3, a voltage drop after adding the conductive pattern M11' is suppressed as compared to prior to adding the conductive pattern M11', and in the present embodiment, an effect of suppressing a voltage drop of about 4% for element number 32 occurs. Note that in the present embodiment, the conductive pattern M11' is not of a shape that reduces the difference in impedance between the lines L1 to L3 substantially. For that reason, in the line L1, there is substantially no effect on the voltage drop due to addition of the conductive pattern M11'.

By the present embodiment, a similar effect to that of the first embodiment can be achieved. That is, the conductive pattern M11 and/or M11' may be provided in at least a part of the outer frame portion of the conductive film M21. Thereby, it is possible to realize an improvement in the rigidity of the substrate 1 along with a suppression of a voltage drop due to the previously described impedance difference and a reduction in a difference in supplied voltages.

Figure 6:
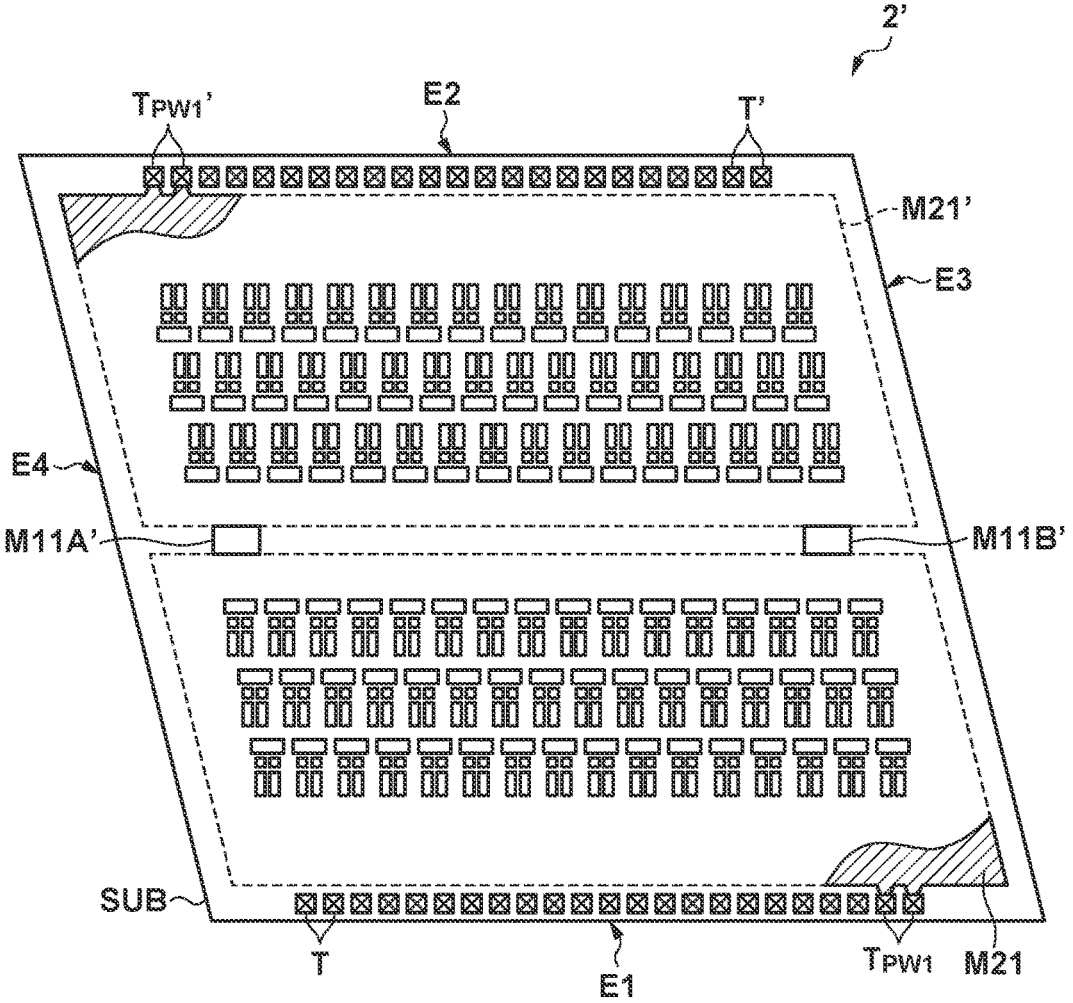
FIG. 6 is a view for describing an example of a structure of the liquid discharging head substrate.

FIG. 6 illustrates a top surface layout of the liquid discharging head substrate 2 according to a variation of the embodiment. In the present variation, a pair of elements, where one element is a structure in which groups of the supply port $OP_{EQ}$, the heater HT, and the driving element DR are arranged, and a plurality of electrode pads T including the power-supply pads $T_{PW1}$, as well as a conductive film M21, are provided point-symmetrically about the center of the semiconductor substrate SUB. The electrode pad T, the power-supply pad $T_{PW1}$, and the conductive film M21 on the edge E2 side are respectively distinguished as "the electrode pad T'", "the power-supply pad $T_{PW1}$'" and "the conductive film M21'".

Also, in the present variation, conductive patterns M11A' and M11B' are arranged in place of the conductive pattern M11'. The conductive pattern M11A' connects a portion on the side of the edge E4 of the conductive film M21 (a portion whose impedance is relatively large) and a portion on the side of the edge E4 of the conductive film M21' (a portion whose impedance is relatively small). The conductive pattern M11B' connects a portion on the side of the edge E3 of the conductive film M21 (a portion whose impedance is relatively large) and a portion on the side of the edge E3 of the conductive film M21' (a portion whose impedance is relatively small). In this way, in the configuration in which two or more conductive films M21 are arranged, the difference in impedance between different portions that may occur between the differing conductive films M21 and M21' is reduced by the conductive patterns M11A' and M11B'. Note that in the present variation, the conductive patterns M11A' and M11B' may be provided in both the wiring layers M1 and M2.

Third Embodiment

Figure 7A:
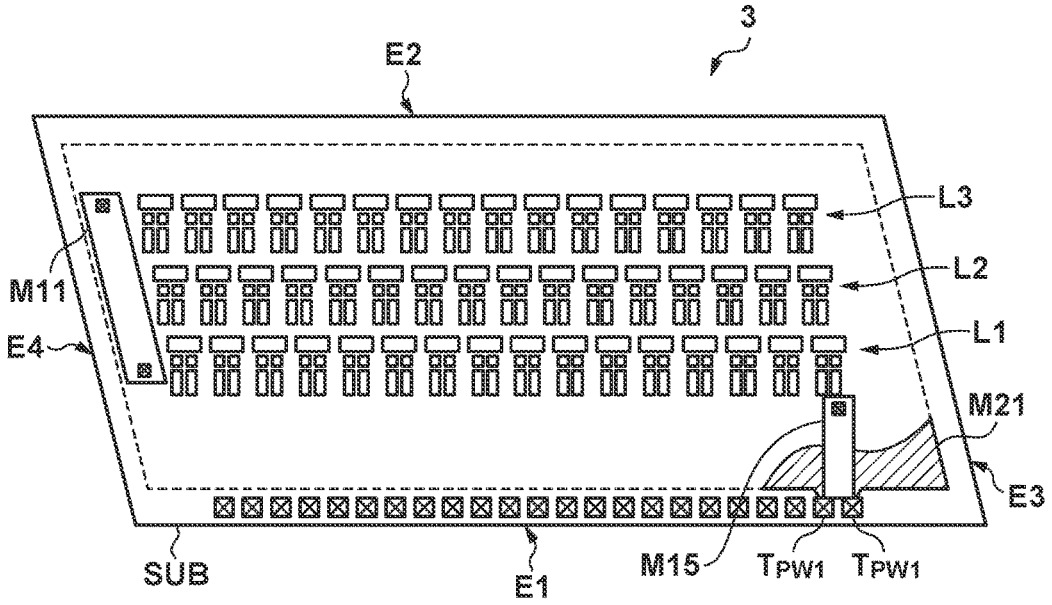
FIG. 7A and FIG. 7B are views for describing an example of a structure of the liquid discharging head substrate.

FIG. 7A illustrates a top surface layout of a liquid discharging head substrate 3 according to a third embodiment. The present embodiment mainly differs from the previously described first embodiment in that a conductive pattern M15 is further arranged from the power-supply pads $T_{PW1}$ to the vicinity of the driving elements DR of the line L1.

The conductive pattern M15 is electrically connected to the power-supply pads $T_{PW1}$ via a connecting portion of another wiring layer and a plug, and extends to the vicinity of the driving element DR on the side of the edge E3 of the line L1 in a direction orthogonal to the edge E1. Also, the conductive pattern M15 is connected at that end by a plug with a portion (referred to as portion P4) in the vicinity of the driving element DR on the side of the edge E3 of the line L1 in the conductive film M21.

Figure 7B:
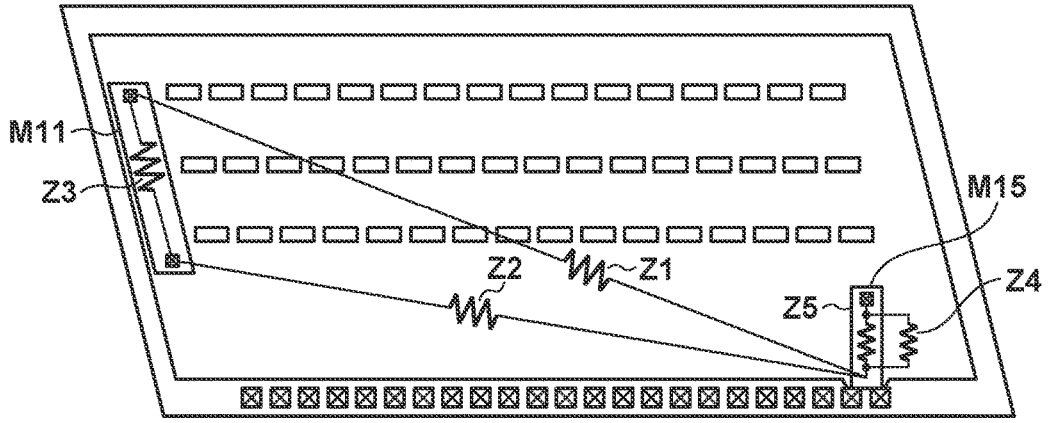

In FIG. 7B, the impedance of the conductive film M21 and the conductive pattern M15 is illustrated similarly to in FIG. 4A in accordance with the top surface layout of the liquid discharging head substrate 3. Here, similar to Z1 and Z2 (refer to the first embodiment), Z4 is the impedance from the power-supply pad $T_{PW1}$ in the conductive film M21 of the portion P4. Also, Z5 is the impedance from one end (the side of the power-supply pads $T_{PW1}$) to the other end (the side of the portion P4) of the conductive pattern M15. Here, assuming that Z4' is the actual impedance of the portion P4 from power-supply pad $T_{PW1}$, Z4' can be expressed as follows.

Specifically, Z4'=Z4×Z5/(Z4+Z5). Accordingly, assuming that ΔZ4 is the difference in impedance of the portion P4 before/after adding the conductive pattern M15, ΔZ4 can be expressed as follows. Specifically, $$\Delta Z4 = Z4 - Z4' = Z4^2 / (Z4 + Z5).$$

Here, in order to reduce the impedance effectively in relation to the portion P1 whose impedance is highest (refer to the first embodiment (FIG. 2A to FIG. 4B)), it is sufficient that $\Delta Z1>\Delta Z4$ holds. Accordingly, it can be said that it is sufficient that the following equation, which is based on the equation of $\Delta Z4$ above and the equation of $\Delta Z1$ described in the first embodiment, holds. Specifically, it is sufficient that $Z3<(Z1/Z4)^2\times Z5+\{(Z1/Z4)-1\}\times Z1-Z2$ holds.

By virtue of the present embodiment, in addition to achieving a similar effect to the first embodiment, it is possible to reduce impedance from the power-supply pads $T_{PW1}$ to the line L1 on the edge E1 side, and there is the additional advantage of suppressing the voltage drop due to the previously described impedance difference and reducing the difference in supplied voltage.

(Other)

While several preferred embodiments have been exemplified above, the present invention is not limited to these examples, and these may be partially changed without deviating from the gist of the present invention, such as by applying the contents of a portion of one embodiment to another embodiment. Also, the individual terms recited in the present specification are merely used with the objective of describing the present invention, and it goes without saying that the present invention is not limited to the strict meaning of these terms, but includes equivalents thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-016975, filed on Feb. 1, 2017, which is hereby incorporated by reference herein in its entirety.

What is claimed is:

1. A liquid discharging head substrate in which a plurality of driving elements for respectively driving a plurality of discharging elements for discharging liquid are arranged on a semiconductor substrate, the liquid discharging head substrate comprising:

a conductive film provided to cover a region in which the plurality of driving elements are arranged in a plan view corresponding to the top surface of the semiconductor substrate, so as to supply a power-supply voltage to the plurality of driving elements; and a power-supply pad provided at an end of the semiconductor substrate in the plan view, and into which the power-supply voltage is inputted from outside, wherein the conductive film has an outer shape that is not linearly symmetrical in relation to a line orthogonal to an edge at which the power-supply pad of the semiconductor substrate is provided in the plan view, and a plurality of openings are disposed in the conductive film, the conductive film has a first portion and a second portion wherein an impedance of the conductive film from the power-supply pad to the second portion is smaller than an impedance of the conductive film from the power-supply pad to the first portion, and the liquid discharging head substrate further comprises a conductive pattern that electrically connects the first portion and the second portion in a layer different to the conductive film.

2. The liquid discharging head substrate according to claim 1, wherein each of the plurality of openings corresponds to a liquid supply port for guiding liquid to the respective discharging element.

3. The liquid discharging head substrate according to claim 1, wherein the conductive film has a plurality of second openings for connecting the plurality of driving elements and the plurality of discharging elements.

4. The liquid discharging head substrate according to claim 3, wherein the plurality of driving elements are arranged at a predetermined pitch, and the plurality of second openings are arranged at the predetermined pitch to respectively correspond to the plurality of driving elements.

5. The liquid discharging head substrate according to claim 1, wherein the power-supply voltage is supplied to the conductive pattern via the conductive film from the power-supply pad.

6. The liquid discharging head substrate according to claim 1, wherein no connecting portion for electrically connecting the conductive pattern to a circuit on the semiconductor substrate is provided between the conductive pattern and the semiconductor substrate.

7. The liquid discharging head substrate according to claim 1, wherein the conductive pattern at one end is electrically connected to the first portion via a plug, and at another end is electrically connected to the second portion via a plug.

8. The liquid discharging head substrate according to claim 1, wherein the plurality of discharging elements are arranged on the semiconductor substrate via a multilayer wiring structure including a plurality of wiring layers, and the plurality of wiring layers include:

a first wiring layer including the conductive pattern;

a second wiring layer including the conductive film; and a third wiring layer including a second conductive film such that the plurality of discharging elements and the plurality of driving elements are arranged in an electrical path between the second conductive film and the conductive film.

9. The liquid discharging head substrate according to claim 8, wherein the second conductive film transmits a second power-supply voltage different to the power-supply voltage.

10. The liquid discharging head substrate according to claim 8, wherein the second conductive film is of a lattice shape in the plan view.

11. The liquid discharging head substrate according to claim 8, wherein the plurality of driving elements are electrically connected to the conductive film, and the plurality of discharging elements are respectively connected in series, and the plurality of discharging elements are electrically connected to the second conductive film.

12. The liquid discharging head substrate according to claim 8, wherein the first wiring layer further includes a line pattern for controlling the plurality of driving elements.

13. The liquid discharging head substrate according to claim 1, further comprising a plurality of electrode pads, wherein the plurality of electrode pads includes the power-supply pad, wherein in the plan view, the semiconductor substrate has a first edge and a second edge that oppose each other and a third edge and a fourth edge that are connected to the first edge and the second edge and that oppose each other, the plurality of electrode pads are arranged along the first edge, the power-supply pad is positioned closer to the fourth edge than to the third edge, and at least one of: (i) the conductive pattern is positioned closer to the second edge than to the first edge and (ii) the conductive pattern is positioned closer to the third edge than to the fourth edge, is true.

14. The liquid discharging head substrate according to claim 1, wherein the semiconductor substrate is a parallelogram in the plan view.

15. A liquid discharging head, comprising the liquid discharging head substrate according to claim 1.

16. A liquid discharging apparatus, comprising the liquid discharging head according to claim 15.

17. A liquid discharging head substrate in which a plurality of driving elements for respectively driving a plurality of discharging elements for discharging liquid are arranged on a semiconductor substrate, the liquid discharging head substrate comprising:

a first conductive film provided to cover a region in which some of the plurality of driving elements are arranged in a plan view corresponding to the top surface of the semiconductor substrate, so as to supply a power-supply voltage to the some of the plurality of driving elements;

a second conductive film provided to cover a region in which the rest of the plurality of driving elements are arranged in the plan view, so as to supply the power-supply voltage to the rest of the plurality of driving elements;

a first power supply pad to which the power-supply voltage is inputted from outside and that is electrically connected to the first conductive film in the plan view; and a second power supply pad to which the power-supply voltage is inputted from outside and that is electrically connected to the second conductive film in the plan view, wherein the first power supply pad is provided at an end of the semiconductor substrate on a side closer to the first conductive film than to the second conductive film, the second power supply pad is provided at an end of the semiconductor substrate on a side closer to the first conductive film than to the second conductive film, the first conductive film and the second conductive film each have an outer shape that is not linearly symmetrical with respect to a line that is orthogonal to an edge at which the first power supply pad of the semiconductor substrate is provided in the plan view, and a plurality of openings are disposed on the first conductive film and the second conductive film, the first conductive film has a first portion and a second portion for which an impedance from the first power supply pad in the first conductive film is smaller than for the first portion, the second conductive film has a third portion and a fourth portion for which an impedance from the second power supply pad in the second conductive film is smaller than for the third portion, and the liquid discharging head substrate further comprises:

a first conductive pattern electrically connected to the first portion and the fourth portion; and a second conductive pattern electrically connected to the second portion and the third portion.

* * * * *